US006026265A

United States Patent [19]

Kinoshita et al.

[11] Patent Number: 6,026,265

[45] Date of Patent: Feb. 15, 2000

[54] TONER CONVEYING ROLL AND DEVELOPING APPARATUS

[75] Inventors: Masahide Kinoshita, Shizuoka-ken; Tetsuya Kobayashi; Yoshiro Saito, both of Numazu, all of Japan

[73] Assignee: Canon Kabushiki Kaisha, Tokyo, Japan

[21] Appl. No.: 09/122,871

[22] Filed: Jul. 27, 1998

[30] Foreign Application Priority Data

Aug. 1, 1997 [JP] Japan ..... 9-220715

[51] Int. Cl.[7] ..... G03G 15/08

[52] U.S. Cl. ..... 399/281; 399/283

[58] Field of Search ..... 399/272, 281, 399/273, 283

[56] References Cited

U.S. PATENT DOCUMENTS 5,086,728 2/1992 Kinoshita ..... 399/281

FOREIGN PATENT DOCUMENTS 0397501 11/1990 European Pat. Off. .
0541375 5/1993 European Pat. Off. .
4-55873 2/1992 Japan .
05061350 3/1993 Japan .
5-61350 3/1993 Japan .
06138774 5/1994 Japan .

OTHER PUBLICATIONS

Patent Abstracts of Japan, vol. 018, No. 441, 28 Aug. 17, 1994.
Patent Abstracts of Japan, vol. 017, No. 372, Jul. 13, 1993.

*Primary Examiner*—Joan Pendegrass
*Attorney, Agent, or Firm*—Fitzpatrick, Cella, Harper & Scinto

[57] ABSTRACT

A toner conveying roll including a rotary shaft, and a surface layer provided around the rotary shaft and formed from a foam elastic body, and wherein the surface layer has a projection extended along an axial direction, and the projection has a substantially trapezoidal cross section. A developing apparatus includes a developing container containing developer, a developer bearing member provided at an opening portion of the developing container and adapted to bear and convey the developer, and a scrape and supply rotary member for scraping and supplying developer while contacting with the developer bearing member, and wherein the scrape and supply rotary member has a surface layer made of foam elastic body and has a projection extending in an axial direction.

22 Claims, 14 Drawing Sheets

TONER CONVEYING ROLL AND DEVELOPING APPARATUS

BACKGROUND OF THE INVENTION

1. Field of the Invention

The present invention relates to a toner conveying roll and a developing apparatus used with an image forming apparatus of electrophotographic or electrostatic type such as a copying machine, a printer and the like.

2. Related Background Art

In copying machines and printers, it is practical that, after an electrostatic image on an image bearing member is developed by a developing apparatus, the developed image on the image bearing member is transferred onto a paper sheet. In such a developing apparatus, by rotating a developing sleeve as a developer (toner) bearing member bearing the toner, the toner is conveyed to a developing station where the developing sleeve is opposed to the image bearing member (photosensitive drum), thereby developing the electrostatic latent image on the photosensitive drum.

In recent years, since an improvement in a resolving power and sharpness of an image has been requested, it is important to form a thin toner layer on the developing sleeve, and, thus, development of method and apparatus for forming the thin toner layer is inevitable. Several techniques regarding this improvement have been proposed.

For example, as disclosed in Japanese Patent Application Laid-Open No. 54-43038, an elastic blade made of runner or metal is urged against a developing sleeve, and, by regulating toner by passing the toner through a nip between the elastic blade and the developing sleeve, a thin toner layer is formed on the developing sleeve and adequate tribo is applied at the nip.

In this case, when nonmagnetic toner is regulated by the elastic blade, an additional toner supplying member for supplying the toner onto the developing sleeve is required. The reason is that, in case of magnetic toner, although the toner can be supplied onto the developing sleeve by a magnetic force of a magnet disposed within the developing sleeve, in case of the non-magnetic toner, the toner cannot be supplied by the magnetic force. In order to supply the toner to the developing sleeve, in the past, techniques in which a roller member formed from a solid rubber material, brush material or foam rubber material is urged against the developing sleeve have been proposed.

The roller member must serve to peel or scrape the toner (not used for development; referred to as "non-development toner" hereinafter) remaining on the developing sleeve, as well as the supply of the toner to the developing sleeve. If such functions are inadequate, the non-development toner is mixed with toner newly supplied in a developing container and the mixed toner exists on the developing sleeve, with the result that, when the toner is next sent to the developing station (where the developing sleeve is opposed to the photosensitive drum) through the elastic blade regulating portion, developing ability is changed due to the difference of toner (new toner and mixed toner), thereby generating a so-called "ghost image".

Accordingly, regarding the roller member, both the toner supplying function and the toner scraping function are required.

First of all, considering the toner supplying function, it is difficult to provide adequate toner conveying ability using a solid material because of surface smoothness of the material, with the result that adequate toner cannot be supplied to the developing sleeve. A brush material has excellent toner supplying ability, but, since dislodging and/or shearing of brush fibers occurs or the brush fibers fall off or are laterally, the brush material is not preferable. To the contrary, since a foam rubber material has many foam bubbles in its surface, the toner conveying ability is greatly improved in comparison with the solid rubber material. Thus, the foam rubber material is suitable as the toner supply roller for supplying the toner to the developing sleeve, and, thus, the foam rubber material has widely been used.

Next, considering the toner scraping function, a method for mechanically scraping the toner by urging a foam elastic roller against an abut portion and a method for electrostatically scraping the toner from the abut portion by applying bias to the foam elastic roller as disclosed in Japanese Patent Application Laid-Open No. 2-191974 are known.

However, since a higher quality image has been requested in recent years, the toner used in the developing apparatus must have smaller particle diameter. Such a toner has a tendency that it is more difficult to be scraped in comparison with the toner having normal particle diameter. Accordingly, in order to prevent occurrence of the ghost image, it is required that the scraping ability is further improved. To this end, it is considered that a mechanical force is further added by using a foam elastic roller having the adequate toner supplying ability and by increasing a penetrating amount of the roller to the developing sleeve, an abut width (referred to as "nip width") between the roller and the developing sleeve or the number of revolutions of the roller.

However, if such a method is used, stress on the toner and the developing sleeve is increased, with the result that, due to deterioration of toner, poor charging, toner fusion and solidification on the developing sleeve, damage of the surface of the developing sleeve or damage of the foam elastic roller itself will occur.

SUMMARY OF THE INVENTION

An object of the present invention is to provide a developing apparatus in which developer (toner) can be scraped and supplied without deterioration and fusion of the developer.

Another object of the present invention is to provide a toner conveying roller having high scraping ability and toner supplying ability.

A further object of the present invention is to provide a developing apparatus comprising a developing container for containing developer, a developer bearing member provided at an opening portion of the developing container and adapted to bear and convey the developer, and a scrape and supply rotary member for scraping and supplying the developer by contacting with the developer bearing member, and wherein the scrape and supply rotary member is formed from foam elastic body and includes a surface layer having projections disposed along an axial direction.

A further object of the present invention is to provide a toner conveying roll comprising a rotary shaft, and a surface layer provided around the rotary shaft and formed from foam elastic body, the surface layer having projections disposed along an axial direction, and the projections have a trapezoidal cross section.

The other object of the present-invention will be apparent from the following detailed explanation of the invention.

DETAILED DESCRIPTION OF THE PREFERRED EMBODIMENTS

A developing apparatus according to the present invention will now be fully explained with reference to the accompanying drawings.

First Embodiment

First of all, a developing apparatus according to a first embodiment of the present invention will be described with reference to FIGS. 1 to 4.

Figure 1:
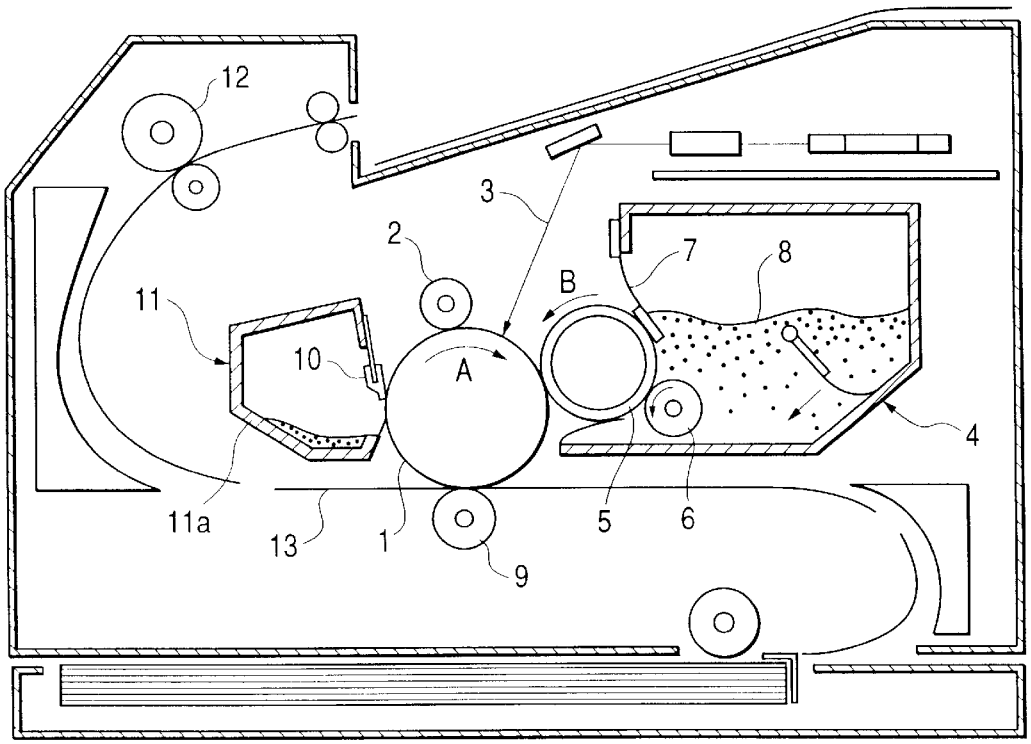
FIG. 1 is a schematic view showing an embodiment of an image forming apparatus using a developing apparatus according to the present invention.

In FIG. 1, a photosensitive drum (image bearing member) 1 is rotated in a direction shown by the arrow A and is uniformly charged by a charge device 2. Then, an electrostatic latent image is formed on a surface of the photosensitive drum by a laser beam (exposure means) 3. The electrostatic latent image is developed as a toner image by a developing apparatus 4 disposed in the vicinity of the photosensitive drum 1. The developing apparatus is incorporated into a process cartridge which can detachably mounted to the image forming apparatus. Incidentally, in the illustrated embodiment, inverse development for forming the toner image on the exposed portion is used.

The visualized toner image on the photosensitive drum 1 is transferred onto a paper sheet (recording medium) 13 by a transfer roller 9. On the other hand residual toner remaining on the photosensitive drum 1 is scraped by a cleaning blade 10 of a cleaning device 11 and is collected into a waste toner container 11*a*. The cleaned photosensitive drum 1 is used for next image formation. The above-mentioned operations are repeated.

The paper sheet 13 to which the toner image was transferred is conveyed to a fixing device 12, where the toner image is fixed to the paper sheet. Then, the paper sheet is discharged out of the image forming apparatus. In this way, the printing operation is completed.

Next, the developing apparatus 4 will be further explained with reference to FIG. 2.

Figure 2:
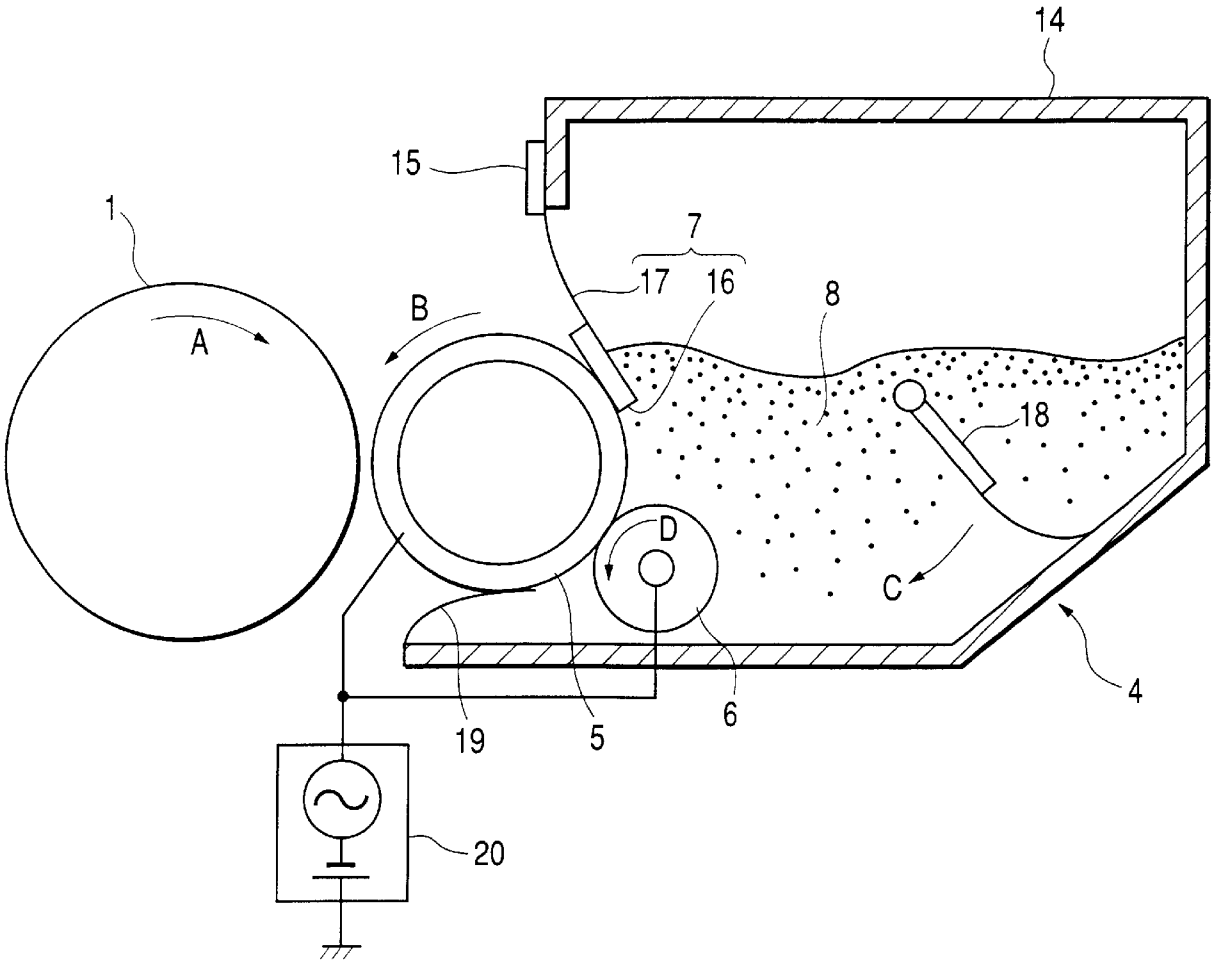
FIG. 2 is a schematic view showing an embodiment of the developing apparatus according to the present invention.

In FIG. 2, the developing apparatus 4 comprises a developing container 14 for containing nonmagnetic toner 8 as one-component developer, and a developing sleeve (developer bearing member) 5 disposed within an opening portion extending along a longitudinal direction of the developing container 14 and is opposed to the photosensitive drum 1 and serves to develop or visualize the electrostatic latent image on the photosensitive drum 1.

In the developing apparatus 4, a substantially right half peripheral surface of the developing sleeve 5 enters into the opening portion, and a substantially left half peripheral surface is exposed out of the developing container 14. The exposed surface of the developing sleeve outwardly of the developing container 14 is opposed to the photosensitive drum 1 disposed at the left side of the developing apparatus 4 with a small gap therebetween. The developing sleeve 5 is rotated in a direction shown by the arrow B, and a surface of the sleeve has moderate unevenness (projections and recesses) for increasing sliding contact with the toner 8 and improving conveyance of the toner. It is preferable that a blast treatment using Arundom abrasive grain or glass beads is effected to form a rough surface including the projections, and conductive particles such as particles of metal oxide, graphite or carbon and phenol resin for binding such particles are used to form the recesses.

Above the developing sleeve 5, there is provided an elastic blade 7 supported by a hold-down metal plate 15. A free end portion of the elastic blade is urged against the outer peripheral surface of the developing sleeve 5 to be surface-contacted with the latter in such a manner that the free end portion is directed toward a direction opposite to a rotational direction of the developing sleeve (counter-direction abutment).

The elastic blade 7 is constituted by a thin metal plate 17 made of SUS or phosphorus bronze having spring elasticity, and an elastic body 16 made of rubber material or elastomer such as urethane or silicone and mounted on the metal plate 17 by injection molding. As the elastomer, polyamide elastomer having moderate elasticity and excellent charge applying ability for toner having negative polarity is preferable.

A toner supply and scrape roller (i.e., elastic roller) 6 for supplying the toner (developer) to the developing sleeve 5 and scraping the toner from the developing sleeve is urged against the developing sleeve 5 at a position upstream of the abutment portion between the elastic blade 7 and the developing sleeve 5 in the rotational direction of the developing sleeve 5 and is rotatably supported. The elastic roller will be fully described later.

In the above-mentioned developing apparatus 4, during the developing operation, the toner 8 in the developing container 14 is sent toward the elastic roller 6 by rotation (in a direction shown by the arrow C) of an agitating member 18. Further, when the elastic roller 6 is rotated in a direction shown by the arrow D, the toner 8 is conveyed in the vicinity of the developing sleeve 5, and, at the abutment area between the developing sleeve 5 and the elastic roller 6, the toner 8 born on the elastic roller 6 is slidingly contacted with the developing sleeve 5, with the result that the toner is frictionally charged to be adhered to the developing sleeve 5.

Thereafter, when the developing sleeve 5 is rotated in the direction B, the toner is sent to the abutment area between the elastic blade 7 and the developing sleeve, where the proper tribo (frictional charge amount) is given and a thin toner layer is formed on the developing sleeve. Thereafter, the toner is conveyed to the developing station where the developing sleeve is opposed to the photosensitive drum 1.

The non-development toner which was not consumed at the developing station is collected at a collecting portion positioned at a lower portion of the developing sleeve 5 when the developing sleeve is rotated. A seal member 19 is provided at the collecting portion, which seal member permits the nondevelopment toner to advance toward the developing container 14 and prevents the toner in the developing container 14 from leaking from the lower portion of the developing sleeve 5.

The nondevelopment toner collected from the developing sleeve 5 is scraped from the surface of the developing sleeve 5 at the abutment area between the elastic roller 6 and the developing sleeve 5. A major amount of the scraped toner is conveyed by the rotation of the elastic roller 6 and is mixed with the toner 8 within the developing container 14, with the result that the charged charges of the toner is dispersed. At the same time, by the rotation of the elastic roller 6, new toner is supplied onto the developing sleeve 5, and the above-mentioned operation is repeated.

In the developing station, the latent image on the photosensitive drum 1 is developed as a toner image by applying AC voltage overlapped with DC voltage (developing AC bias) from a power source 20 to the developing sleeve 5.

Next, a concrete example of various elements of the developing apparatus 4 according to the illustrated embodiment will be explained.

In the developing sleeve 5, a surface of an aluminium sleeve having a diameter of 16 mm is subjected to fixed-form blast treatment using glass beads (#600) to obtain surface roughness Rz of about 3 $\mu$m. The developing sleeve 5 is opposed to the photosensitive drum 1 to form a gap of 300 $\mu$m therebetween and is rotated at a peripheral speed of 80 mm/s slightly faster than a peripheral speed (50 mm/s) of the photosensitive drum 1.

The toner 8 is nonmagnetic one-component developer and has average particle diameter of 8 $\mu$m. The elastic blade 7 is constituted by adhering or molding polyamide elastomer (elastic body 16) having a thickness of 1 mm onto the thin metal plate made of phosphorus bronze having spring elasticity and a thickness of 0.1 mm.

Figure 3:
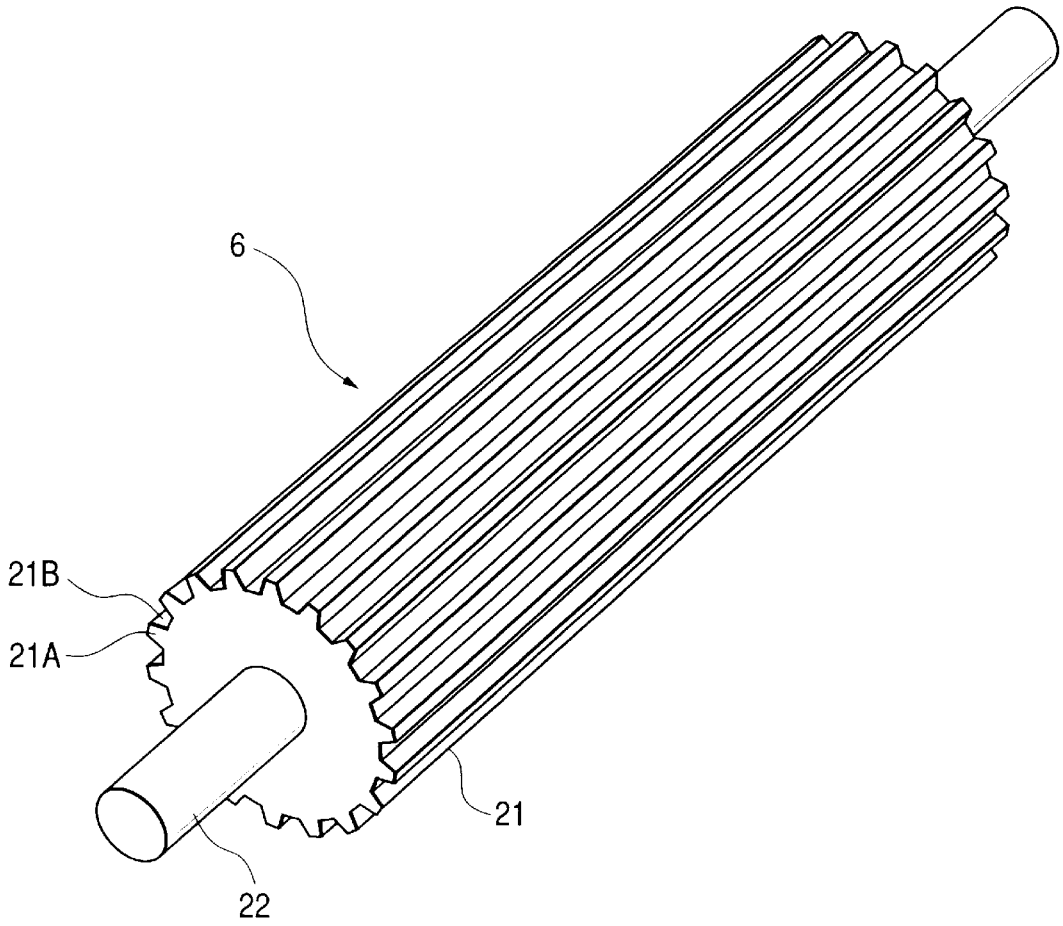
FIG. 3 is a schematic perspective view of a toner supply and scrape roller used in the developing apparatus according to the present invention.

As shown in FIG. 3, the elastic roller (toner supply and scrape roller) 6 is constituted by adhering foam 21 made of polyurethane or silicone to a metal core (rotary shaft) 22 to obtain a roller shape, and unevenness (projections and recesses) is formed on an outer surface of the roller along a circumferential direction. That is to say, a plurality of projections and recesses extending in an axial direction are formed alternately along the circumferential direction.

As a method for providing the projections and recesses, (1) a method for foaming material within a mold having projections and recesses, (2) a method for extruding foam material through a mold having projections and recesses to form projections and recesses on the outer surface of the foam material, or (3) a method for forming projections and recesses on material by using heated nichrome wires. Among them, the method (3) is not preferable because, when the material is cut by the heated wires, since heat is applied to the foam material to fuse a cell wall, thereby increasing hardness locally, and, thus, when the foam material is urged against the developing sleeve 5, the toner is damaged. Further, the method (2) has disadvantages that it is difficult to form fine projections and recesses and an inner cell wall is apt to be cut when the projections and recesses are formed on the surface. Accordingly, it is preferable that the method (1) is used as the method for providing the projections and recesses, and, in the illustrated embodiment, the method (1) is used.

Regarding the number of cells in the foam material, it is preferable that the number of cells per inch is about 50 to 200 in consideration of toner supply, and, in the illustrated embodiment, polyurethane foam having the number of cells of 75 per inch is used.

Figure 4:
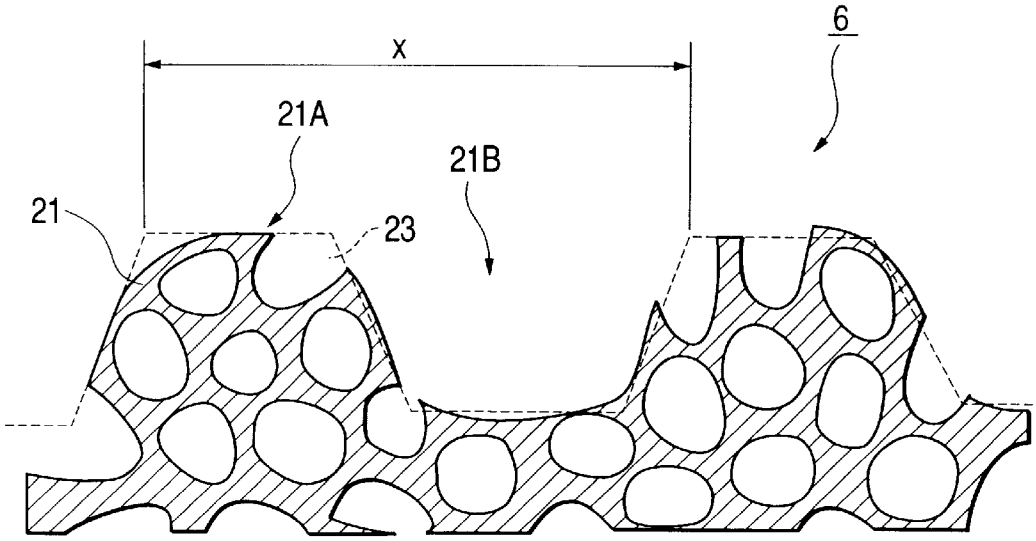
FIG. 4 is an enlarged view showing projections and recesses of the toner supply and scrape roller of FIG. 3.

The surface of the elastic roller 6 is shown in FIG. 4 in an enlarged scale. FIG. 4 shows a condition that unevenness (projections and recesses) of the sectional portion of the elastic roller 6 is observed by an optical microscope. The cell wall is shown by the hatched area. As shown in FIG. 4, since the cell wall is partially cut as shown in FIG. 4, the actual unevenness is defined by the broken line 23 extending substantially along outer periphery of projections 21A and recesses 21B in FIG. 4. Namely, the unevenness may be continuously formed on the elastic roller 6 in the circumferential direction. However, at least one projection 21A must be positioned in the abutment area (nip) between the elastic roller and the developing sleeve 5 to effect the scraping of the toner.

In the illustrated embodiment, more specifically, the elastic roller 6 having an outer diameter of 15 mm is used and is positioned within the developing apparatus to provide the abut nip width of 5 mm with respect to the developing sleeve 5. A distance between the adjacent projections (unevenness pitch "X" in FIG. 4) is selected to 2 mm, and two or three projections exist in the abut nip width. Further, a height of each projection is 0.8 mm.

The inventors performed tests by using the developing apparatus including the above-mentioned elastic roller 6 in order to ascertain the effect of the unevenness.

The elastic roller 6 was rotated by a drive means (not shown) at a speed of 60 mm/s in the same direction as the developing sleeve 5, and 3000 sheets were printed. In this case, in the developing operation, as the developing bias applied to the developing sleeve 5 from the power source 20, DC voltage of −400 V was overlapped with AC voltage having frequency of 2000 Hz and peak-to-peak voltage of 2000 V, and the inverse development was effected with surface potential of the latent image on the photosensitive drum 1 of −600 V (at nonexposed portion) and −150 V (at exposed portion).

At the same time, a cylindrical elastic roller having no unevenness and having an outer diameter of 15.0 mm was mounted within the developing apparatus, and, by providing the nip width of 5 mm (between the elastic roller and the developing sleeve 5) as a comparison example 1 and the nip width of 7 mm as a comparison example 2, image forming operations were performed with the same conditions regarding others. Test results are shown in the following Table 1:

TABLE 1

| Condition | Ghost | Fog |
|---|---|---|
| First embodiment | ○ | ○ |
| Comparison example 1 | X | ○ |
| Comparison example 2 | ○ | X |

The elastic roller 6 according to the first embodiment achieved good results regarding the ghost image (phenomenon in which, when a certain pattern is developed, a toner consumed portion and a toner non-consumed portion are generated, with the result that developing density difference is generated between the toner consumed portion and the toner non-consumed portion during next one revolution of the developing sleeve 5), fog due to deterioration of toner at a latter half of endurance, and density.

To the contrary, in the comparison example 1, although a good result was obtained regarding the fog due to deterioration of toner at the latter half of endurance, since the toner scraping ability is insufficient, the ghost image reached an undesirable level. In the comparison example 2, since the nip width is great, the scraping ability was improved and a good result was obtained regarding the ghost image; but, since the stress on the toner was too high, the fog due to deterioration of toner at the latter half of endurance was generated.

Namely, by forming the unevenness (projections and recesses) as is in the first embodiment, a three-dimensional body is formed on the roller surface unlike to the conventional cylindrical elastic foam roller, and, by abutting the projections against an abut portion (developing roller) with a certain degree of freedom, frequency of contacts during the abutment is increased. In other words, by adopting the arrangement according to the first embodiment, since the cells in the foam at the recesses (which do not define the outermost periphery of the roller) have good flexibility, the frequency of contacts with the abut portion can be increased.

Further, the toner scraped by the projections can be held not only in the cells but also in the recesses themselves. Further, as the elastic roller is rotated, when each projection leaves the abut nip (between the developing sleeve 5 and the elastic roller), the projection is vibrated elastically to scrape the toner on the developing sleeve 5, thereby improving the toner scraping ability. As a result, the stable and adequate toner scraping ability can be obtained while maintaining the good toner conveying ability without giving excessive stress to the toner and the developing sleeve 5.

In the illustrated embodiment, while an example that the developing apparatus is incorporated into the process cartridge which can detachably mounted to the main body of the image forming apparatus was explained, the developing apparatus may be secured within the main body of the image forming apparatus to supply only the toner, or the developing apparatus may be incorporated into a process cartridge (which can detachably mounted to the main body of the image forming apparatus) together with the photosensitive drum, the cleaning blade, the waste toner container and the charge device.

As mentioned above, in the developing apparatus according to the present invention, since the toner supply and scrape roller for supplying the toner to the developer bearing member such as the developing roller and scraping the toner from the developer bearing member is constituted by the rotary shaft and the foam elastic body disposed around the rotary shaft and the circumferential unevenness is formed on the outer peripheral surface of the foam elastic body, the three-dimensional body is formed on the roller surface unlike to the conventional cylindrical elastic foam roller, and, since the projections abut against the developer bearing member with a certain degree of freedom, frequency of contacts during the abutment is increased. That is to say, with this arrangement, since the cells in the foam at the recesses (which do not define the outermost periphery of the roller) have good flexibility, the frequency of contacts with the developer bearing member can be increased. Further, since the toner scraped by the projections can be held not only in the cells but also in the recesses themselves, the conveying ability for the scraped toner is also improved. Further, as the elastic roller is rotated, when each projection leaves the abut nip (between the developer bearing member and the elastic roller), the projection is vibrated elastically to behave to scrape the toner on the developer bearing member, thereby improving the toner scraping ability.

As a result, the stable and adequate toner scraping ability can be obtained while maintaining the good toner conveying ability without giving excessive stress to the toner and the developer bearing member, thereby providing a stable developing apparatus having no ghost and no fog.

Second Embodiment

An embodiment of an elastic roller 6 used in the developing apparatus according to the present invention will be described with reference to FIG. 5. As described in connection with FIGS. 3 and 4 in the first embodiment, the elastic roller 6 is constituted by adhering foam 21 made of polyurethane or silicone to a metal core (rotary shaft) 22 to obtain a roller shape, and unevenness (projections and recesses) is formed on an outer surface of the roller along a circumferential direction. In the illustrated embodiment, polyurethane foam having the number of cells of 75 per inch is used as the foam material.

Now, lengths of the projections and recesses of the elastic roller 6 will be described. The enlarged sectional view of the projections and recesses of the elastic roller 6 is the same as shown in FIG. 4. As shown in FIG. 4, the actual unevenness is defined by the broken line 23 extending substantially along outer periphery of projections and recesses, and a dimensional relation thereof is defined as shown in FIG. 5.

Figure 5:
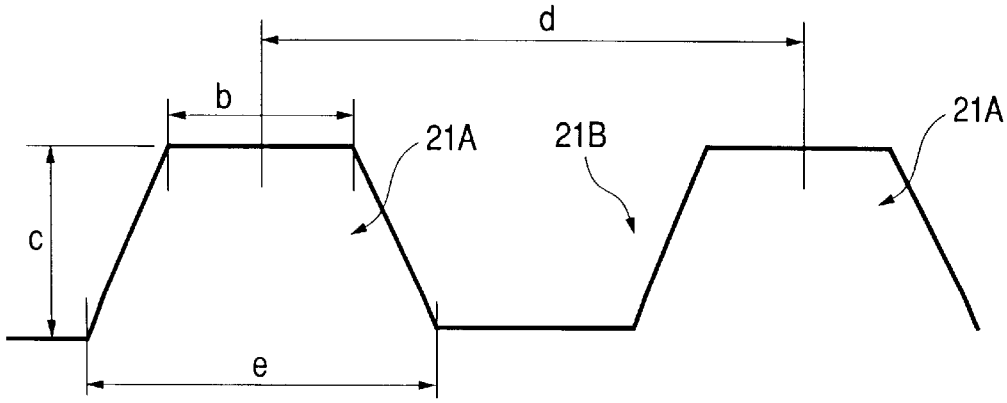
FIG. 5 is an explanatory view for defining lengths of various portions of the projections and recesses of the toner supply and scrape roller.

In FIG. 5, "b" indicates a width of the outer peripheral surface of the projection 21A, "c" indicates a radial distance from the outer peripheral surface of the recess 21B to the outer peripheral surface of the projection 21A, i.e., a height of the projection, "d" indicates a circumferential distance from a circumferential center of the outer peripheral surface of the projection 21A to a circumferential center of the outer peripheral surface of the adjacent projection 21A, i.e., a pitch and "e" indicates a circumferential length of a root portion of the projection. Further, regarding a diameter of the cell, at least ten cells existing in the section shown in FIG. 4 are measured, and the measured values are averaged to obtain a cell diameter a.

The inventors performed tests by using elastic rollers 6 having various configurations in order to find the optimum configuration of the unevenness.

First of all, it was found that a maximum magnitude of the projection 21A is associated with the magnitude of the cells in the foam. That is to say, it is required that the length "b" of the outer peripheral surface of the projection 21A is selected to be greater than the cell diameter "a" and the radial distance "c" from the outer peripheral surface of the recess 21B to the outer peripheral surface of the projection 21A, i.e., the height of the projection 21A is selected to be greater than at least the cell diameter "a". Doing so, at least one cell wall is formed on the outer surface and side surfaces of the projection, with the result that the projections can be formed stably and the toner scraping ability and toner conveying ability of the projection (outer surface and side surfaces) can be improved. On the other hand, as a result of tests performed by using an elastic roller in which the length "b" of the outer peripheral surface of the projection and the height "c" of the projection are smaller than the cell diameter "a", it was found that portions having no projection are locally formed, and, thus, it is difficult to form the projections stably.

Further, the circumferential length "e" of the root portion of the projection 21A is selected to be greater than at least the cell diameter a and be greater than the length "b" of the outer peripheral surface of the projection. With this arrangement, the root portion of the projection can be stabilized.

While the minimum magnitude of the projection 21A was determined in this way, it was found that a maximum value of the projection 21A is determined by the abut nip width between the elastic roller and the developing sleeve 5. Namely, in order to obtain the effect of the unevenness, it is required that at least one projection 21A and recess 21B exist within the abut nip. With this arrangement, as the developing sleeve is rotated, when any point on the developing sleeve 5 rotated in the same direction as the elastic roller 6 passes through the nip, the toner on such a point can be scraped by the projection 21A without fail.

Accordingly, by selecting the circumferential distance (pitch) "d" from the circumferential center of the outer peripheral surface of the projection to the circumferential center of the outer peripheral surface of the adjacent projection to be smaller than the nip width "w" so that the projection 21A and the recess 21B always exist within the nip width "w" between the elastic roller 6 and the abut member (developing roller), it is important that the toner is positively scraped by the projection and the toner is positively conveyed by the recess.

In conclusion, by satisfying relations $a \leqq b \leqq e < d \leqq w$ and $a \leqq c$, upper and lower limits of the length of the unevenness are determined, and the projections can be stabilized and the positive abutment against the abut member can surely be effected.

However, an upper limit of the height "c" of the projection is not determined. Thus, the inventors performed tests for determining the upper limit, and it was found that the upper limit of the height "c" of the projection can be determined in accordance with the pitch "d".

More specifically, it was found that, by satisfying a relation $c \leqq d$, the effect of the provision of the unevenness can be achieved and the good toner scraping and conveying ability can be obtained. Incidentally, if $c > d$, when the urged projection is fallen or laid laterally, such a projection may strike against the adjacent projection. If this occurs, the abutment of the adjacent projection against the developing sleeve 5 becomes unstable to reduce the rate of the frictional sliding and, when the projection is laid laterally, the recess is closed by the laid projection, thereby worsening the toner conveying ability. Accordingly, in order to avoid the above inconvenience, $c \leqq d$ is preferable.

The inventors manufactured the following roller as the elastic roller 6 satisfying the above relations $a \leqq b \leqq e < d \leqq w$ and $a \leqq c \leqq d$. That is to say, a roller having a=0.3 mm, b=0.5 mm, c=0.5 mm, d=1.5 mm, e=0.8 mm, metal core diameter=5.0 mm and outer diameter=15.0 mm was manufactured.

And, such an elastic roller 6 was mounted within the developing apparatus in such a manner that the abut nip width of 5 mm was obtained between the elastic roller and the developing sleeve 5. In this condition, 3000 sheets were printed while the elastic roller was being rotated at a speed of 60 mm/s in the same direction as the developing sleeve 5 by means of the drive means (not shown). In this case, during the developing operation, the developing bias to be applied from the power source 20 to the developing sleeve 5 was obtained by overlapping DC voltage of −400 V with AC voltage having frequency of 2000 Hz and peak-to-peak voltage of 2000 V, and the inverse development was effected at the exposure portion so that the surface potential of the latent image on the photosensitive drum 1 has non-exposed portion potential of −600 V and exposed portion potential of −150 V.

At the same time, a cylindrical elastic roller having no unevenness and having an outer diameter of 15.0 mm was mounted within the developing apparatus, and, by providing the nip width of 5 mm (between the elastic roller and the developing sleeve 5) as a comparison example 3 and the nip width of 7 mm as a comparison example 4, image forming operations were performed with the same conditions regarding others.

Test results are shown in the following Table 2:

TABLE 2

| Condition | Ghost | Fog |
|---|---|---|
| Second embodiment | ○ | ○ |
| Comparison example 3 | X | ○ |
| Comparison example 4 | ○ | X |

The elastic roller 6 according to the second embodiment achieved good results regarding the ghost image, fog due to deterioration of toner at a latter half of endurance, and density.

To the contrary, in the comparison example 3, although a good result was obtained regarding the fog due to deterioration of toner at the latter half of endurance, since the toner scraping ability is insufficient, the ghost image reached an undesirable level. In the comparison example 4, since the nip width is great, the scraping ability was improved and a good result was obtained regarding the ghost image; but, since the stress on the toner was too high, the fog due to deterioration of toner at the latter half of endurance was generated.

Namely, by forming the unevenness (projections and recesses) as is in the second embodiment, three-dimensional body is formed on the roller surface, and, by abutting the projections against an abut portion (developing roller) with a certain degree of freedom, frequency of contacts during the abutment is increased in comparison with the conventional cylindrical foam toner convey roller. In other words, by adopting the arrangement according to the second embodiment, since the cells in the foam at the recesses (which do not define the outermost periphery of the roller)

have good flexibility, the frequency of contacts with the abut portion can be increased.

As a result, the stable and adequate toner scraping ability can be obtained while maintaining the good toner conveying ability without giving excessive stress to the toner and the developing sleeve 5.

Namely, the elastic roller according to the illustrated embodiment has the projections and recesses on the circumferential surface of the foam elastic body and is used to be contacted with the member bearing the toner at its surface with the predetermined nip width "w". Further, the elastic roller is designed so that, when the cell diameter of the foam elastic body is a, the length of the outer peripheral surface of the projection is "b", the circumferential distance from the circumferential center of the outer peripheral surface of the projection to the circumferential center of the outer peripheral surface of the adjacent projection is "d", the radial distance from the outer peripheral surface of the recess to the outer peripheral surface of the projection is "c" and the circumferential length of the root portion of the projection is "e", the relations $a \leqq b \leqq e < d \leqq w$ and $a \leqq c$ are satisfied. With this arrangement, the stable and adequate toner scraping ability can be obtained while maintaining the good toner conveying ability, without utilizing any electrostatic force and without deterioration of the toner and deterioration and damage of the developer bearing member.

Third Embodiment

In a third embodiment of the present invention, concrete constructions of various elements are selected as follows.

The developing sleeve 5 is formed by coating phenol resin dispersing carbon therein and having a thickness of about 10 μm on an aluminium sleeve having a diameter of 16 mm so that surface roughness Ra of about 0.9 μm is obtained. The developing sleeve is opposed to the photosensitive drum 1 to form a gap of 300 μm therebetween and is rotated at a peripheral speed of 199 mm/s slightly faster than a peripheral speed of 117 mm/s of the photosensitive drum.

The toner 8 is nonmagnetic one-component toner and has an average particle diameter of 6 μm. The elastic blade 7 is constituted by molding polyamide elastomer (elastic body 16) on a thin metal plate having elasticity and a thickness of 0.1 mm and made of phosphorus bronze to obtain a total thickness of 1 mm.

Next, the toner supply and scrape roller, i.e., elastic roller 6 used in the developing apparatus according to the third embodiment will be fully explained.

In the third embodiment, as shown in FIG. 3, the elastic roller 6 is constituted by surrounding foam roller 21 around a metal core 22 having a diameter of 5 mm to provide an outer diameter of 17 mm. The foam roller 21 is provided at its surface with a plurality of projections 21A and recesses 21B which are uniformly distributed. The projections 21A and recesses 21B extend in parallel with the metal core (i.e., in an axial direction) and are formed alternately in a circumferential direction.

The elastic roller 6 is urged against the developing sleeve (abut member) 5 and is rotated at a speed of 158 mm/s in the same direction as the developing sleeve 5 by means of the drive means (not shown).

The foam roller 21 is formed from polyurethane foam having open cells. In consideration of uniformity of cell sizes and antideformation of the cells, polyurethane of ester group is preferable. As mentioned above, the foam roller 21 is provided at its surface with a plurality of projections 21A and recesses 21B which are uniformly distributed, and the projections 21A and recesses 21B extend in parallel with the metal core and are formed alternately in the circumferential direction.

Now, the unevenness (projections and recesses) of the foam roller 21 will be fully described.

Figure 6:
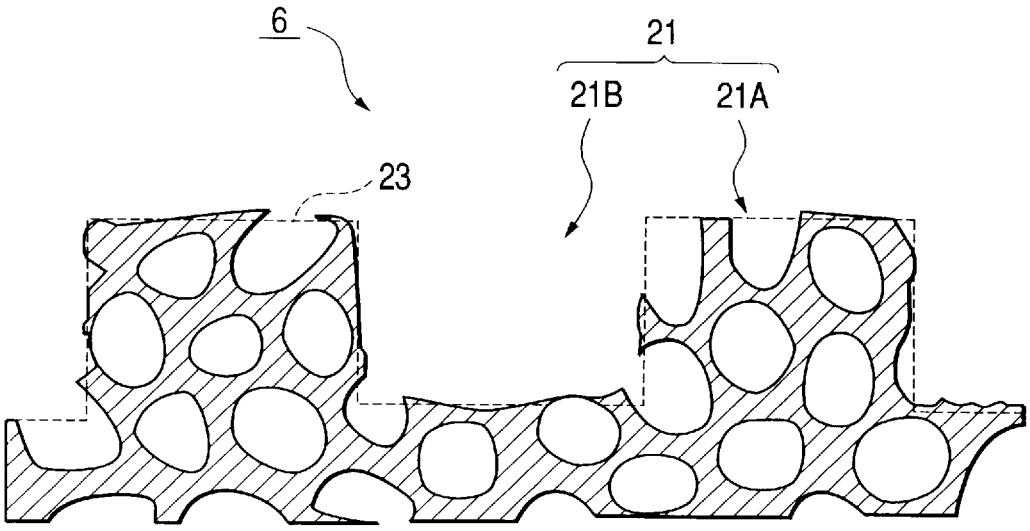
FIG. 6 is an enlarged view showing projections and recesses of a toner supply and scrape roller similar to FIG. 4.

First of all, as shown in FIG. 6, the measurement of the configuration of the unevenness is effected by observing a radial section of the foam roller 21 by means of an optical microscope and photo-taking such a radial section and by describing the broken line 23 substantially along the outline.

Figure 7:
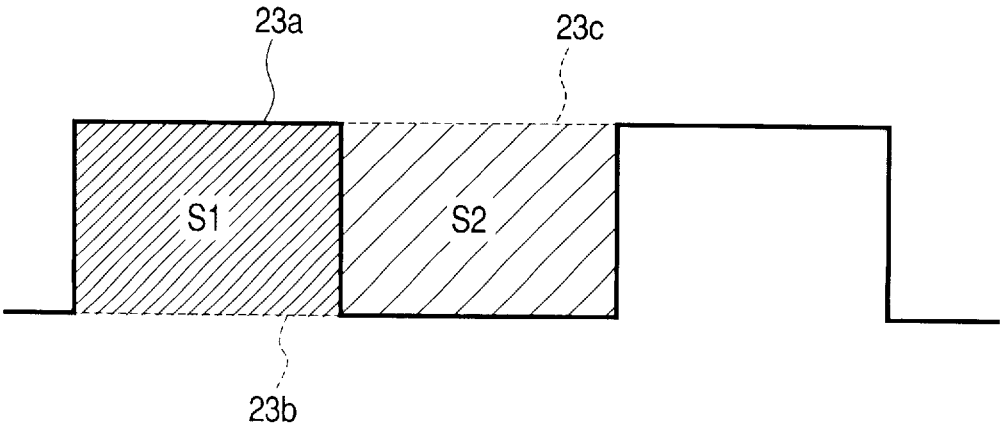
FIG. 7 is an explanatory view for defining lengths of various portions of the projections and recesses of the toner supply and scrape roller of FIG. 6.

Further, cross-sectional areas of the projections 21A and the recesses 21B are determined in the similar manner, and, as shown in FIG. 7, the cross-sectional area S1 of the projection 21A is determined as an area enclosed by an outline 23*a* of the projection and an auxiliary line 23*b* connecting between base portions (having minimum diameters; referred to as "inner diameter portions" hereinafter) of adjacent recesses, and the cross-sectional area S2 of the recess 21B is determined as an area enclosed by an outline 23*a* defining the projection and an auxiliary line 23*b* connecting between top portions (having maximum diameters; referred to as "outer diameter portions" hereinafter) of adjacent projections.

Figure 8:
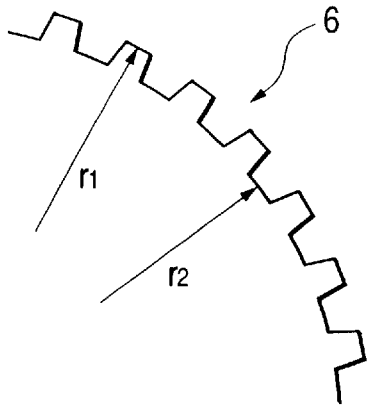
FIG. 8 is a sectional view of an outer peripheral portion of the toner supply and scrape roller.
Figure 9:
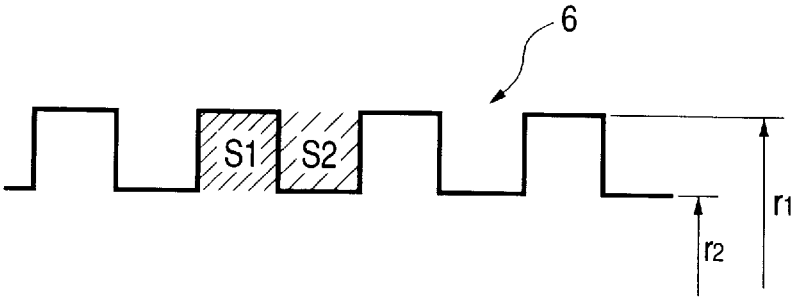
FIG. 9 is an enlarged view of the toner supply and scrape roller of FIG. 8.

FIG. 8 is a partial sectional view of the outer peripheral portion of the elastic roller 6 according to the illustrated embodiment, and FIG. 9 is an enlarged view of the outer peripheral portion.

As shown in FIG. 8, in the elastic roller 6, a diameter $r_1$ of the outer diameter portion is 17.0 mm, and a diameter $r_2$ of the inner diameter portion is 16.4 mm. The cross-sectional areas S1 and S2 of the projection and recess are 0.158 $mm^2$ and 0.162 $mm^2$, respectively, which are substantially the same as shown.

The elastic roller 6 according to the illustrated embodiment was mounted to the developing apparatus shown in FIG. 2 and 5000 sheets were printed by using the image forming apparatus shown in FIG. 1.

In this case, in the developing operation, as the developing bias applied to the developing sleeve 5 from the power source 20, DC voltage of −400 V was overlapped with AC voltage having frequency of 2000 Hz and peak-to-peak voltage of 1600 V, and the inverse development was effected with surface potential of the latent image on the photosensitive drum 1 of −600 V (at non-exposed portion) and −150 V (at exposed portion). As a result, it was found that no inconvenience is generated in the image and deformation, damage and cracking of the elastic roller 6 do not occur after 5000 sheet were printed.

Figure 10:
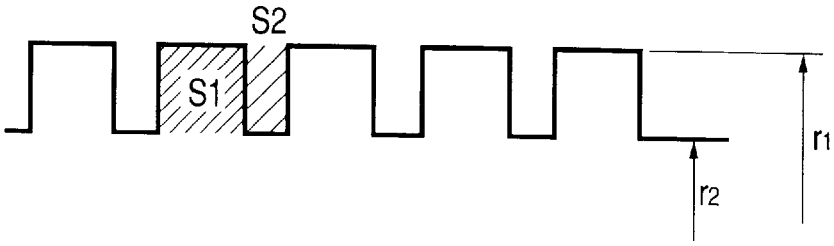
FIGS. 10 and 11 are enlarged views showing an outer peripheral portion of a comparison example used in tests according to a third embodiment.
Figure 11:
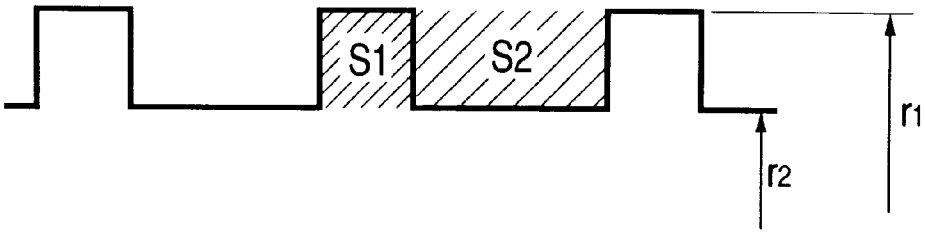

And, as comparison examples regarding the elastic roller 6 according to the illustrated embodiment (referred to as "configuration A" hereinafter), elastic rollers shown in FIGS. 10 and 11 were manufactured from the same material, and such rollers were compared with the elastic roller 6 according to the illustrated embodiment. Incidentally, a cross-sectional area S1 of a projection of the elastic roller shown in FIG. 10 (referred to as "configuration B" hereinafter) is 0.150 $mm^2$ and a cross sectional area S2 of a recess is 0.092 $mm^2$, and a cross sectional area S1 of a projection of the elastic roller shown in FIG. 11 (referred to as "configuration C" hereinafter) is 0.165 $mm^2$ and a cross-sectional area S2 of a recess is 0.314 $mm^2$.

Regarding an evaluating method, the elastic rollers were mounted to the developing device shown in FIG. 2, respectively, and 5000 sheets were printed by using the image forming apparatus shown in FIG. 1 under a low temperature/low humidity environmental condition (15° C./10% RH), and, particularly, fog and ghost were observed and evaluated.

Figure 12:
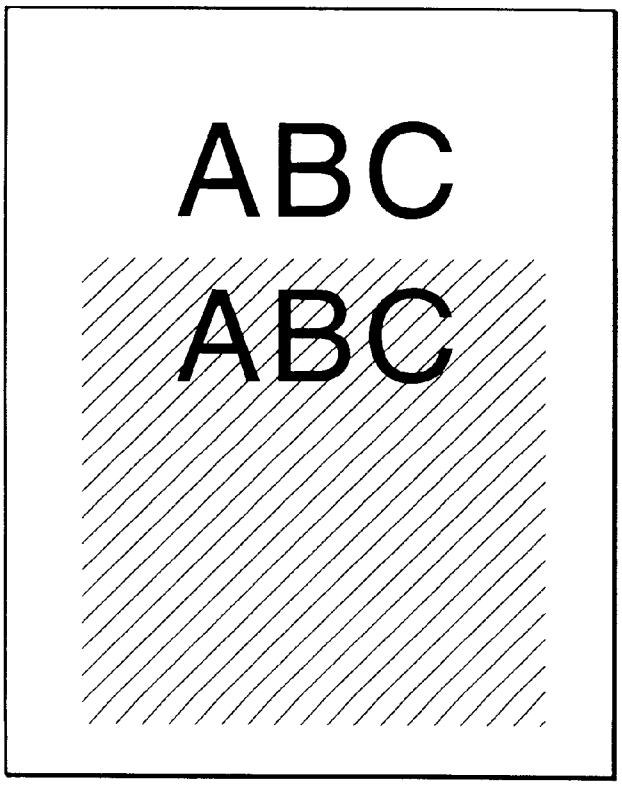
FIG. 12 is an explanatory view showing an example of a ghost image.

The ghost image is an image as shown in FIG. 12, and the ghost is a phenomenon in which the toner remaining on the developing sleeve 5 (which was not used for development) in the developing process is not scraped by the foam elastic roller (elastic roller 6), with the result that a developing pattern (traces of toner consumed portion and toner non-consumed portion) is generated on the image during the next revolution of the developing sleeve 5. This phenomenon occurs when the scraping ability is worsened. Under the low temperature/low humidity environmental condition, since the toner is apt to be charged, and, due to a force thereof, the toner becomes hard to be separated from the developing sleeve, thereby generating the noticeable ghost image.

Evaluating results of the rollers are shown in the following Table 3.

TABLE 3

| Configuration | Area S1 of projection | Area S2 of recess | Ghost | Fog | Roller after used |
|---|---|---|---|---|---|
| A | 0.158 $mm^2$ | 0.162 $mm^2$ | ○ | ○ | Normal |
| B | 0.150 $mm^2$ | 0.092 $mm^2$ | ○→X | ○→X | Break in projection |
| C | 0.165 $mm^2$ | 0.314 $mm^2$ | ○ | ○ | Normal |

As mentioned above, regarding the configuration A, the image had no problem and the roller after used had no inconvenience.

Regarding the configuration B, although the image had no problem in the initial prints, inconvenience such as fog and ghost was generated in the image when 5000 sheets were printed. Further, observing the roller after used, the projections were partially broken and the projections which were not broken were clogged by high density toner to become harder. When the scraped toner penetrates into the projection, if the toner pushed out of the projection smoothly enters into the succeeding recess (not trapped in the projection), the good scraping ability can be maintained. However, in the configuration B, although the good scraping ability can be maintained in the initial prints, since the cross-sectional area S2 of the recess (toner receiving portion) is smaller than the cross sectional area S1 of the projection, the toner cannot be pushed out from the projection sufficiently and is partially trapped in the projection. When the scraping operation is continued, since the trapped toner is accumulated and the density of the toner in the projection is gradually increased, the flow of the toner in the projection becomes slow and the scraping ability is worsened, thereby generating the ghost image. Further, since the projection within which the density of the toner is increased is hardened, the stress on the toner is increased to deteriorate the toner, with the result that the stable charging of the toner cannot be achieved, thereby generating the fog image. Further, the hardened projection becomes weak mechanically and is broken.

On the other hand, regarding the configuration C, similar to the configuration A, the image had no problem, and the roller after used had no inconvenience. The reason is that, since the recess has great volume (in contrast with the configuration B), similar to the configuration A, the toner smoothly flows from the projection to the recess, with the result that the scraping ability can be maintained stably.

As mentioned above, in the elastic roller 6 having the foam roller provided at its outer surface with the projections and the recesses which are uniformly distributed, by satisfying a relation S1≦S2 between the cross sectional area S1 of the projection and the cross sectional area S2 of the recess, the stable toner scraping ability and the stable toner conveying ability can be ensured.

Fourth Embodiment

Next, another embodiment of an elastic roller 6 capable of being used in the developing apparatus according to the present invention will be explained with reference to FIGS. 13 to 16.

Figure 13:
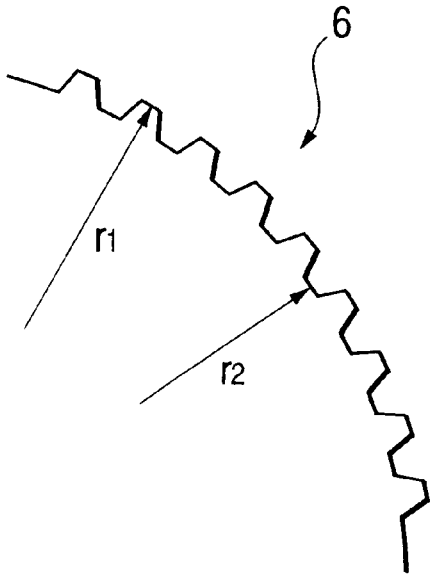
FIG. 13 is a sectional view of an outer peripheral portion of the toner supply and scrape roller.
Figure 14:
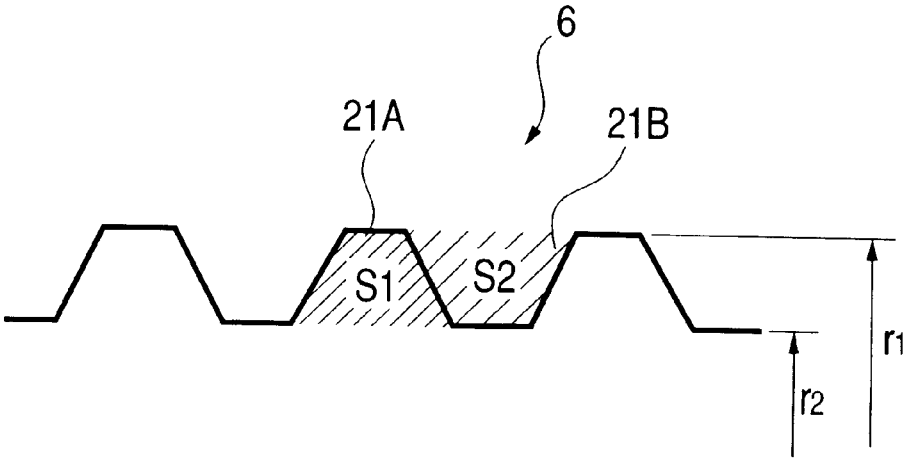
FIG. 14 is an enlarged view of the toner supply and scrape roller of FIG. 13.

FIGS. 13 and 14 are a partial sectional view and an enlarged view showing an outer peripheral portion of the elastic roller 6 according to the fourth embodiment.

In the elastic roller 6 according to the illustrated embodiment, each projection 21A is formed as a trapezoid a width of which is gradually decreased toward the outer peripheral surface, thereby reinforcing the projection and improving the scraping ability. Further, when the unevenness is designed to satisfy the relation S1≦S2, by deriving relation equations for the configuration forming elements, design and manufacture are facilitated.

Figure 15:
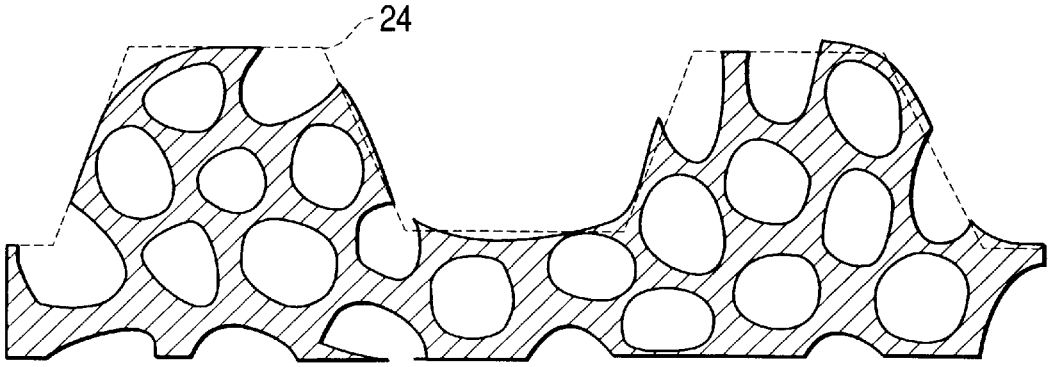
FIG. 15 is a schematic view showing an outer peripheral portion of a toner supply and scrape roller according to a fourth embodiment of the present invention.

As shown in FIG. 15, as is in the third embodiment, the measurement of the configuration of the unevenness is effected by observing a radial section of the foam roller 21 by means of an optical microscope and photo-taking such a radial section and by describing the broken line 24 substantially along the outline.

Figure 16:
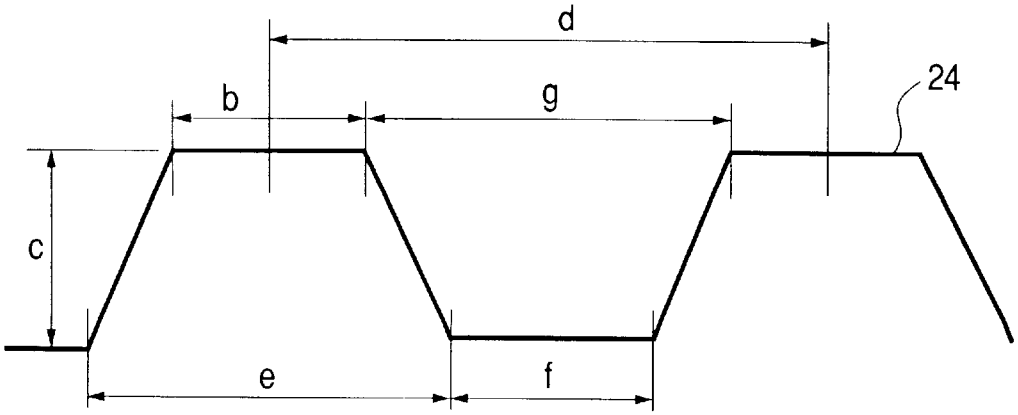
FIG. 16 is an explanatory view for defining lengths of various portions of projections and recesses of the toner supply and scrape roller according to the fourth embodiment.

FIG. 16 shows various constructural elements of the configuration of the unevenness based on the line 24. In FIG. 16, "b" indicates a width of the top surface of the projection, "c" indicates a height of the projection, "e" indicates a width of the bottom of the projection, "f" indicates a width of the bottom of the recess, "g" indicates a width of the top of the recess, and "d" indicates a pitch between two adjacent projections.

When it is assumed that the projection and the recess are both trapezoid, the cross sectional area S1 of the projection becomes $(½)\times(b+c)\times e$, and the cross sectional area S2 of the recess becomes $(½)\times(f+g)\times e$. Further, the pitch is the sum of the width "b" of the top surface of the projection and the width "g" of the top of the recess, and, thus, $d=b+g$.

As mentioned in connection with the third embodiment, in order to maintain the stable scraping ability, S1≦S2 may be satisfied, and, this corresponds to $b+c \leqq f+g$. Since $d=b+g$, a relation $2b+c-f \leqq d$ is derived. When this relation is satisfied, the relation S1≦S2 is also satisfied, thereby maintaining the stable scraping ability.

In the illustrated embodiment, an elastic roller having b=0.33 mm, c=0.90 mm, d=1.34 mm, f=0.39 mm, e=0.26 mm and outer diameter=17.0 mm was manufactured, and such an elastic roller 6 was mounted within the developing apparatus described in connection with the third embodiment. In this condition, 5000 sheets were printed. As a result, the image had no problem and the roller after used had no inconvenience.

As mentioned above, by satisfying the relation $2b+c-f \leqq d$ regarding the constructural elements of the configuration of the unevenness, the stable scraping ability can be obtained. Further, since the configuration can be determined without seeking the cross sectional areas of the projection and the recess, the design and manufacture are facilitated.

As apparent from the above explanation, according to the elastic rollers of the third and fourth embodiments, when the projections and the recesses formed on the outer peripheral surface of the foam elastic body satisfy the relation S1≦S2 (where, S1 is the radial cross sectional area of each projection and S2 is the radial cross sectional area of each recess), the stable and sufficient toner scraping ability can be achieved while maintaining the good toner conveying ability, without utilizing any electrostatic force and without deterioration of the toner and deterioration and damage of the abut member.

Further, when the projections and the recesses formed on the outer peripheral surface of the foam elastic body satisfy the relation $2b+e-f \leqq d$ (where, "b" is the length of the outer peripheral surface of the projection, "d" is a distance from the center of the outer peripheral surface of the projection to the center of the outer peripheral surface of the adjacent projection, "e" is the length of the root portion of the projection in the circumferential direction), the same effect can be achieved, and the design and manufacture can be facilitated.

Fifth Embodiment

FIGS. 17 to 20 show a further embodiment of a toner supply and scrape roller (elastic roller 6) capable of being used in the developing apparatus according to the present invention.

Figure 17:
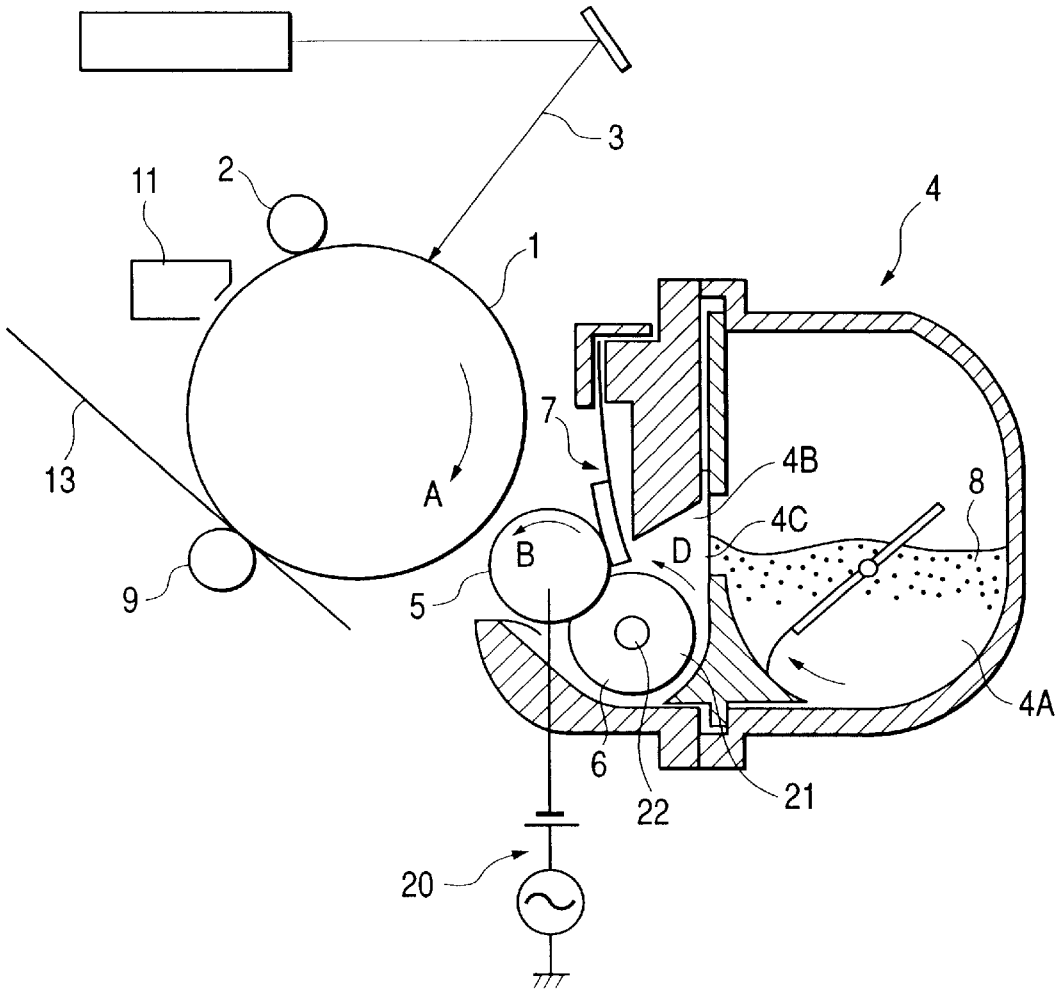
FIG. 17 is a schematic view showing an image forming apparatus having a developing apparatus utilizing the toner supply and scrape roller according to the present invention.

FIG. 17 is a schematic view showing an image forming apparatus having a developing apparatus 4 according to an embodiment of the present invention and using one-component nonmagnetic toner.

In the image forming process of the image forming apparatus, first of all, a surface of a photosensitive drum (electrostatic latent image bearing member) 1 is uniformly charged by a first charger 2 with dark portion potential VD of −700 V, and, then, image exposure is effected by using laser beam emitted from an exposure device (having a laser light source) in response to image information, thereby forming an electrostatic latent image having bright portion potential VL of −50 V on the surface of the photosensitive drum 1. Then, the latent image is inverse-developed by the developing apparatus 4 with nonmagnetic toner, thereby visualizing the latent image as a toner image.

The toner image formed on the photosensitive drum 1 is transferred onto a transfer material 13 supplied to the photosensitive drum 1, by means of a transfer roller 9. The transfer material 13 to which the toner image was transferred is conveyed to a fixing device (not shown), where the toner image is fixed to the transfer material as a permanent image. Residual toner remaining on the photosensitive drum 1 is removed by a cleaning device 11.

In the illustrated embodiment, the developing apparatus 4 comprises a toner chamber 4A and a developing chamber 4B. When the developing apparatus 4 is new (non-used), a seal 4C disposed between the toner chamber 4A and the developing chamber 4B is removed when the developing apparatus is used. A toner conveying member is positioned within the toner chamber 4A, and one-component, nonmagnetic toner having negative polarity is contained in the toner chamber. By rotating the toner conveying member, the nonmagnetic toner in the toner chamber 4A is conveyed to the developing chamber 4B while being agitated.

A developing sleeve 5 is rotatably disposed in an opening portion of the developing chamber 4B opposed to the photosensitive drum 1, and an elastic roller 6 is rotatably disposed at a rear side of the developing sleeve 5 opposite to the photosensitive drum 1.

The elastic roller 6 is rotated in a direction D with having a relative speed with respect to the developing sleeve 5 rotated in a direction B, so that the residual toner remaining on the developing sleeve 5 is scraped and new toner conveyed to the developing chamber 4B by the toner conveying member is conveyed to and coated on the developing sleeve 5. In the illustrated embodiment, the elastic roller 6 has a metal core 22 having a diameter of 5 mm and has an outer diameter of 17 mm.

The nonmagnetic toner coated on the developing sleeve 5 is conveyed toward a developing area (where the developing sleeve is opposed to the photosensitive drum 1) by rotation of the developing sleeve 5; meanwhile, a thin toner layer having a predetermined thickness is formed on the developing roller by a regulating blade 7 urged against the surface of the developing sleeve 5. The regulating blade 7 is formed from an elastic single member made of urethane rubber or the like, or a sheet member made of urethane rubber or the like adhered onto an elastic member made of phosphorus bronze. The toner conveyed to the developing area develops the latent image on the photosensitive drum 1 by utilizing developing bias applied from a bias power source 20 to the developing sleeve 5.

In the illustrated embodiment, the image forming apparatus is designed so that a process speed is 120 mm/s and 16 prints having A4 size can be obtained every minute. The developing sleeve 5 has a diameter of 16 mm and is rotated at 250 rpm so that it is rotated at a peripheral speed which is 180% of the peripheral speed (process speed) of the photosensitive drum 1 to obtain the adequate image density.

Figure 18:
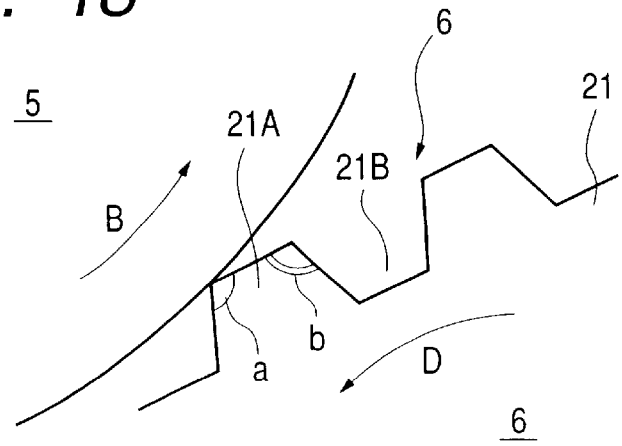
FIG. 18 is an explanatory view showing a nip between the toner supply and scrape roller and a developing sleeve.

FIG. 18 is a perspective view of the elastic roller 6 according to the illustrated embodiment. As shown in FIG. 3, the elastic roller 6 is formed from a sponge (foam elastic body) roller obtained by coating a foam elastic body layer (foam urethane sponge layer) 21 on a rotary shaft (metal core) 22, and unevenness is formed on an outer peripheral surface of the sponge layer 21 along an axial direction of the supply roller 4. The elastic roller 6 is manufactured by disposing the metal core (rotary shaft) 22 and urethane material within a mold (for the roller) having high mold releasing ability and then by foaming the urethane by heat and then by removing the obtained sponge roller from the mold and then by effecting film removal treatment regarding the outer peripheral surface of the sponge roller to open the foam cells on the outer peripheral surface.

As mentioned above, in the past, although heated nichrome wires have been used for the surface working of the sponge roller, since the degree of fusion of sponge at the surface is great, the manufactured toner supply roller had a thin film at its surface to worsen the toner conveying ability, or, during the surface working, fused matter were adhered to the nichrome wires to worsen the cutting ability, or, since the cutting resistance is great, dimensional accuracy of the outer diameter of the roller was worsened considerably. To avoid this, when sponge material having a large number of cells and high density is used, the outer diameter of the roller is generally worked by grinding. However, when the roller is ground while rotating the roller, the unevenness cannot be formed on the surface of the roller.

In the illustrated embodiment, the unevenness (projections and recesses) are previously formed on the surface of the mold for the roller so that the unevenness can be formed on the sponge layer 21. In this way, even when the elastic roller 6 has the complicated configuration (provided at its outer surface with the projections 21A and the recesses 21B) as shown in FIG. 3, the roller can be manufactured with high accuracy without having fused urethane at its surface.

As shown in FIG. 18 which is an explanatory view showing a nip between the elastic roller 6 according to the illustrated embodiment and the developing sleeve 5, the recesses 21B provided in the sponge layer 21 of the elastic roller 6 serve to contain and convey the toner. Each projection 21A has a trapezoidal shape in which the bottom is greater than the top.

The developing sleeve 5 is rotated in a direction B and the elastic roller 6 is rotated in a direction D opposite to the direction B. In this way, a downstream corner (in a rotational direction of the elastic roller 6) "a" of the projection 21A is firstly contacted with the developing sleeve 5 and then an upstream corner "b" is contacted with the developing sleeve. The downstream corner a conveys the toner at its upstream side in the rotational direction, and, when it is contacted with the developing sleeve 5, it serves to mechanically scrape the residual toner remaining on the developing sleeve 5. Further, the upstream corner "b" serves to support the force acting on the downstream corner "a", together with its root portion.

Figure 19:
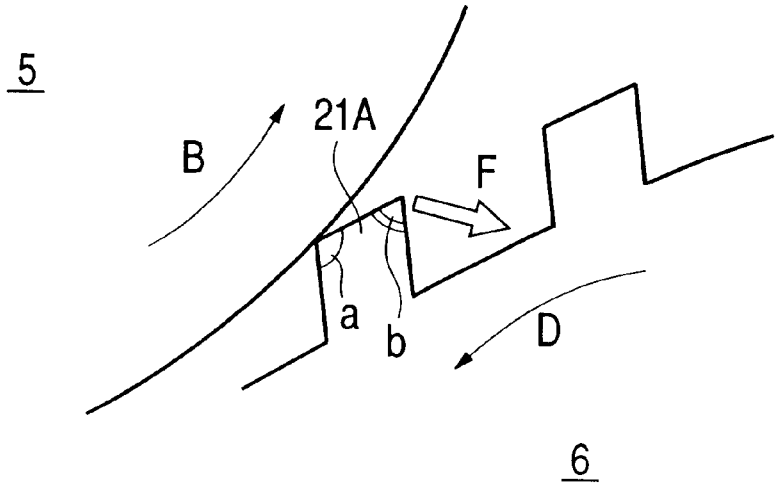
FIG. 19 is an explanatory view showing a condition that corner portions upstream of the projections of the outer peripheral surface of the toner supply and scrape roller are small.

Accordingly, as shown in FIG. 19, if the upstream corner "b" of the projection 21A is small, the projection 21A is laid laterally by a force F acting on the corner "b" when the downstream corner "a" abuts against the developing sleeve. To avoid this, it is preferable that an angle ∠b of the upstream corner "b" is greater than 90° and is also greater than an angle ∠a of the downstream corner "a". That is to say, $$\angle a \leqq \angle b, \text{ and, } 90^\circ \leqq \angle b$$

Figure 20:
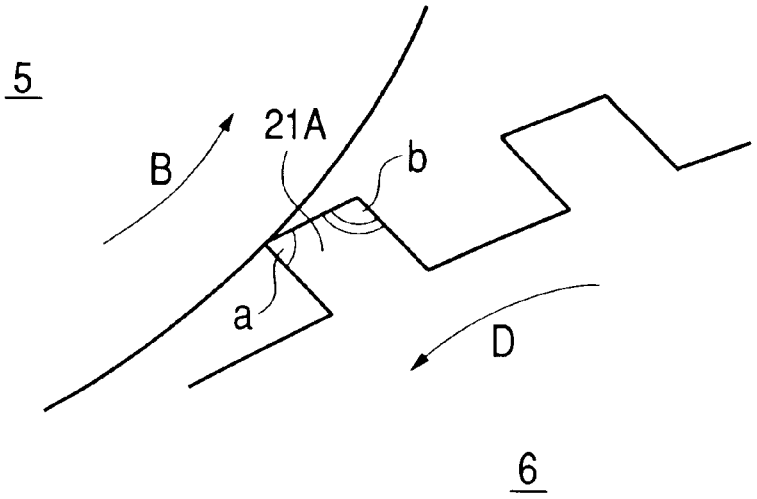
FIG. 20 is an explanatory view showing a condition that corner portions downstream of the projections of the outer peripheral surface of the toner supply and scrape roller are smaller than 90°.

On the other hand, as shown in FIG. 20, even when the angle of the downstream corner "a" is selected to be smaller than 90° to further improve the scraping ability, so long as the angle of the upstream corner "b" satisfy the above relation, the projection is not laid laterally. In this way, the toner scraping ability is further improved.

In the illustrated embodiment, the elastic roller 6 was incorporated into the developing apparatus 4 shown in FIG. 17 and the image formation for continuously outputting solid black image was performed. It was found that, from a first print to a last (50th) print, good images having uniform density can be obtained. Further, image formation for outputting half tone image was performed in similar manner. In case of the half tone image, under the low temperature/low humidity environmental conditions, if the scraping force for scraping the residual toner remaining on the developing sleeve 5 is insufficient, since the residual toner remaining on the developing sleeve accumulates the charges, the developing ability is worsened, thereby decreasing the image density. However, by using the elastic roller 6 according to the illustrated embodiment, the half tone image having always stable density can be obtained.

Sixth Embodiment

Figure 21:
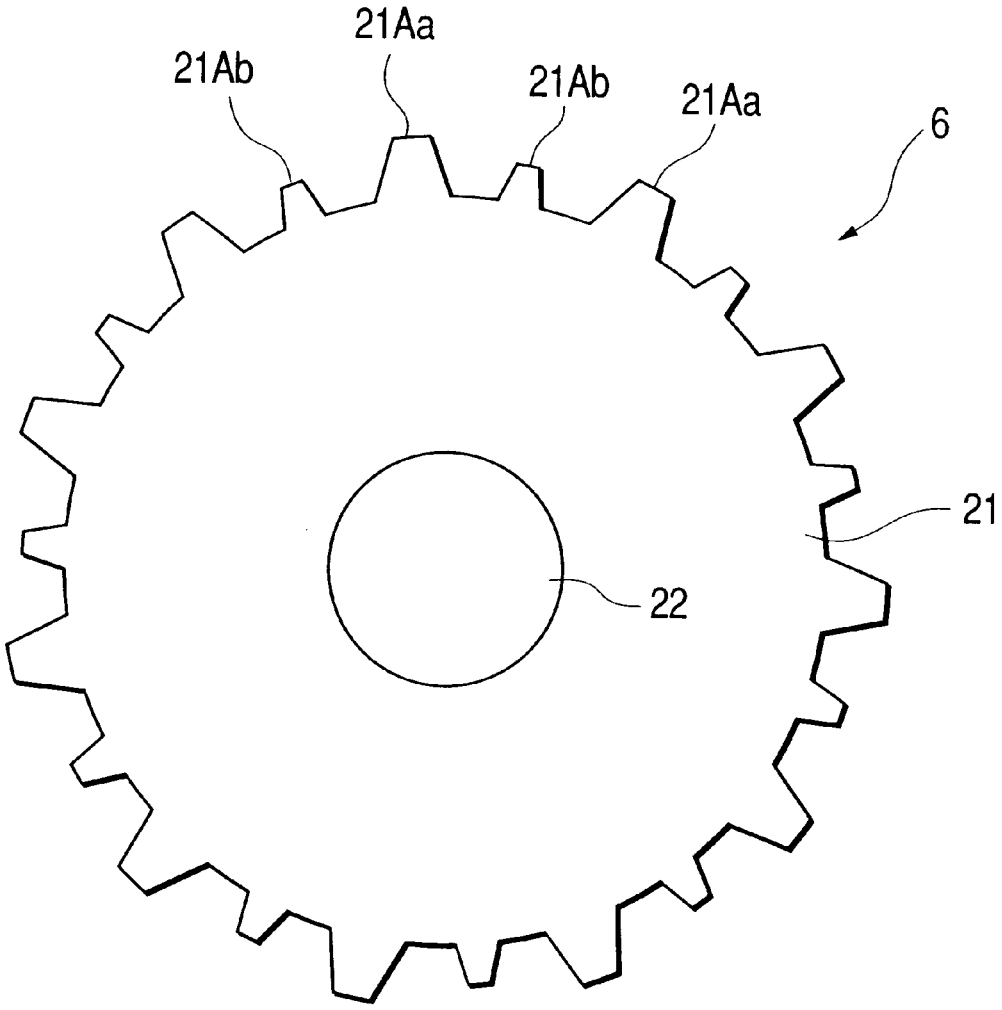
FIG. 21 is a sectional view showing another embodiment of a toner supply and scrape roller.

FIG. 21 is a sectional view showing a still further embodiment of an elastic roller 6. In this sixth embodiment, higher and large projections 21Aa and lower and small projections 21Ab (disposed between the higher projections 21Aa) are formed on the sponge layer 21 of the elastic roller 6. In this way, by separating the toner conveying ability from the toner scraping ability, both abilities are further improved. When it is desired that much toner is supplied onto the developing sleeve 5 by means of the elastic roller 6, a distance between the projections 21Aa may be increased and the height of each projection 21Aa may be increased. With this arrangement, a large amount of toner can be held in recesses between the projections 21Aa, and, when the projection 21Aa abuts against the developing sleeve 5, the large amount of toner held in the recess between the contacted projection 21Aa and the upstream (in the rotational direction of the roller) projection 21Aa can be supplied to the developing sleeve 5.

On the other hand, in order to increase the toner scraping ability of the toner supply roller (elastic roller 6) for scraping the toner from the developing sleeve 5, the lower small projection 21Ab may be provided between the higher large projections 21Aa to increase the number of contacts between the projections and the developing sleeve 5.

In the illustrated embodiment, since the elastic roller 6 is constituted as mentioned above, the toner conveying ability is increased, and, thus, even when the solid black images are outputted continuously, images having uniform density can be obtained stably. Further, since the sufficient toner scraping ability is maintained, the toner on the developing sleeve 5 can always be replaced by new toner, thereby preventing the deterioration of toner, and thus preventing the occurrence of fog. Further, since the lower projections 21Ab are disposed between the adjacent higher projections 21Aa, the trace generated when the higher projection 21Aa abuts against the developing sleeve 5 can be prevented from generating pitch unevenness in the image.

In the illustrated embodiment, while an example that the higher and large projections 21Aa and the lower and small projections 21Ab are alternately arranged was explained, projections having different heights may be arranged at random to make the pitch unevenness unnoticeable.

Seventh Embodiment

A still further embodiment of an elastic roller 6 will be explained.

Figure 24:
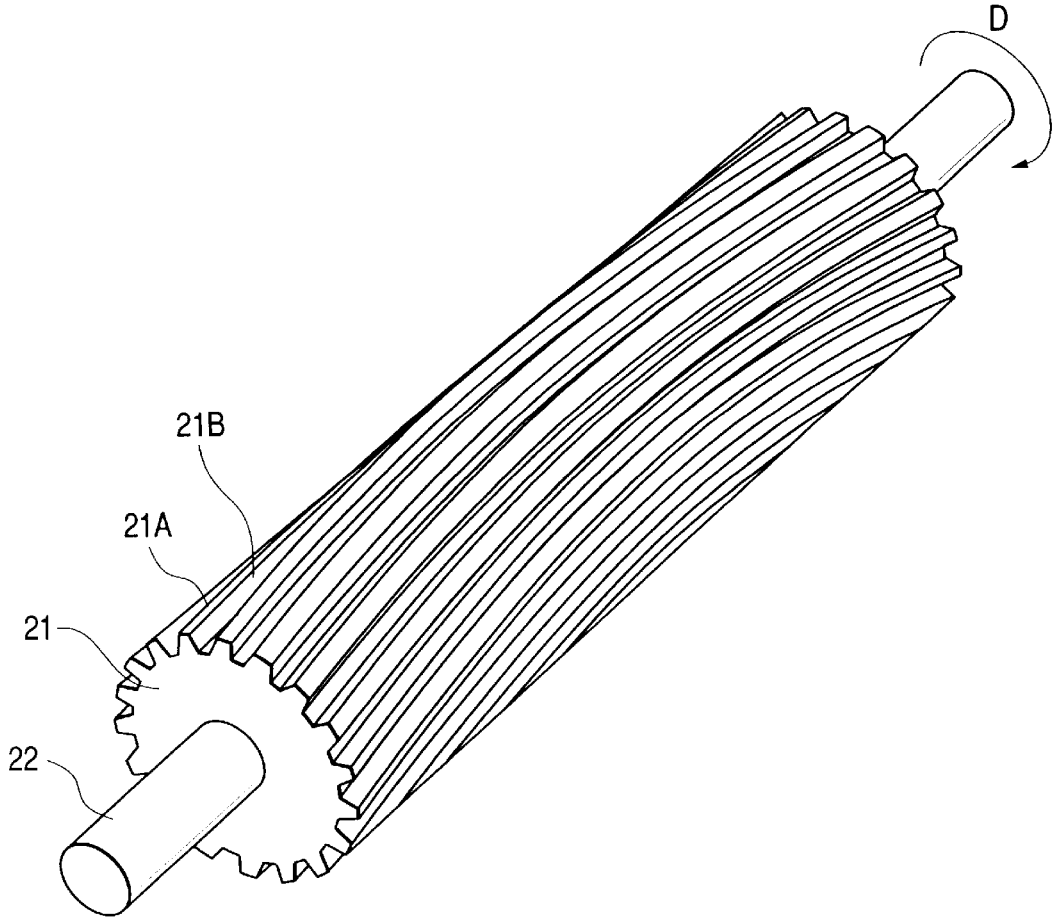
FIG. 24 is a perspective view of a toner supply and scrape roller according to a further embodiment of the present invention.

In this embodiment, as shown in FIG. 24, the unevenness, i.e., projections 21A on the sponge layer 21 of the elastic roller 6 are inclined at an angle smaller than 45° from ends to the center of the roller with respect to the axis of the roller in a direction opposite to the rotational direction D of the roller. And, the inclined angle is maximum at the ends and is gradually decreased toward the center so that the angle at the center becomes minimum. More specifically, the inclination of the projection 21A has an angle of 10° (reverse direction) and is continuously decreased toward the center so that the inclination has an angle of 0° at the center.

In the developing apparatus 4 shown in FIG. 17, if there is a great gap between the ends of the elastic roller 6 and inner walls of the apparatus, the toner is trapped in the gap. And, if internal pressure of the trapped toner is increased, the toner will leak through seals at the ends of the elastic roller 6 or the trapped toner forms lumps which in turn enter into the nip between the regulating blade 7 and the developing sleeve 5, thereby causing void in the image.

On the other hand, when an arrangement in which the elastic roller 6 abuts against the inner walls of the developing apparatus 4 is adopted, due to the sliding contact between the roller and the inner walls, since the sponge layer 21 of the elastic roller 6 is damaged, the ends of the elastic roller 6 is lightly contacted with the inner walls or spaced apart from the inner walls with a small gap of several mm.

Figure 22:
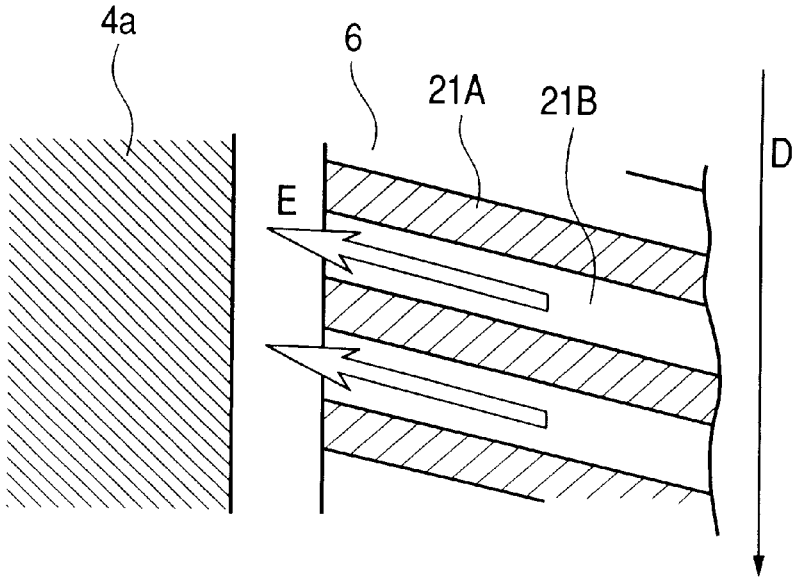
FIG. 22 is an explanatory view showing improper inclination of the projections of the outer peripheral surface of the toner supply and scrape roller with respect to an axis of the roller.

However, even when the elastic roller 6 is lightly contacted with the inner walls or spaced apart from the inner walls with small gap, as shown in FIG. 22, in the case where the projections 21A on the outer peripheral surface of the sponge layer 21 are inclined to be lifted (as shown by the arrow E) toward the ends, looked at from the nip between the elastic roller and the developing sleeve 5, as the elastic roller 6 is rotated in the direction D, the toner is lifted in the direction E toward the ends through the recess 21B between the projections 21A to be pushed toward the inner walls 4*a* of the developing apparatus 4. Accordingly, to avoid this, it is preferable that the projections 21A are not lifted toward the ends of the elastic roller 6.

Figure 23:
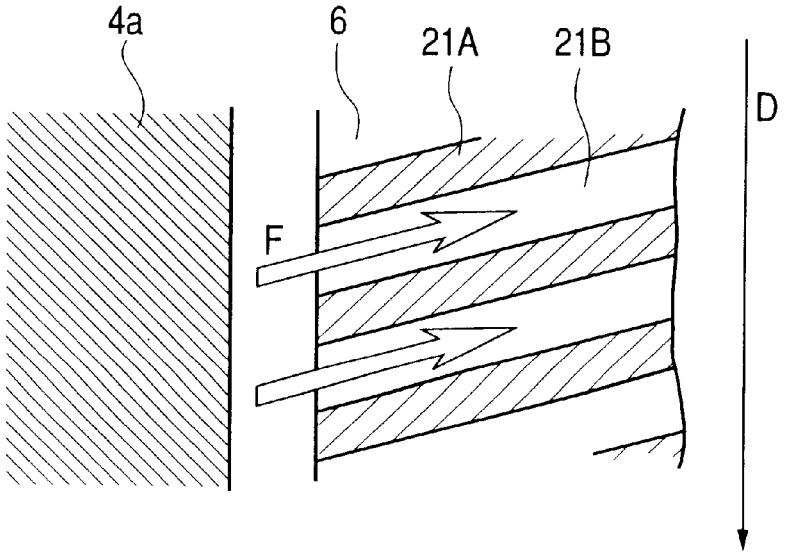
FIG. 23 is an explanatory view showing proper inclination of the projections of the outer peripheral surface of the toner supply and scrape roller with respect to an axis of the roller.

As shown in FIG. 23, when the elastic roller 6 is looked at toward a front side from the nip between the elastic roller and the developing sleeve 5, in the case where the projections 21A of the elastic roller 6 are inclined to be lifted (as shown by the arrow F) toward the center, as the elastic roller 6 is rotated, since the toner is lowered in the direction F toward the center through the recesses 21B, the toner is not pushed toward the inner walls 4*a* of the developing apparatus 4.

However, if the inclination angle of the projection 21A with respect to the axis of the elastic roller 6 is too great, the toner scraping ability for scraping the toner from the developing sleeve 5 (one of functions of the elastic roller 6) is worsened. In order to maintain the toner scraping ability and the toner conveying ability of the elastic roller 6, it is proper that the inclination angle of each projection 21A with respect to the axis of the elastic roller is selected to be equal to or smaller than 45°.

In the illustrated embodiment, since the elastic roller 6 has the above-mentioned construction, the toner scraping ability and the toner conveying ability of the elastic roller 6 can be maintained efficiently.

The elastic rollers 6 according to the seventh embodiment and the fifth embodiment were mounted to the developing apparatus 4 shown in FIG. 17 and acceleration tests for idly rotating the developing apparatus 4 were effected to check toner leakage from the seals at the ends of the elastic rollers 6. As a result, it was found that, when the elastic roller of the fifth embodiment is used, the toner leakage from the end seals occurs, but, when the toner supply roller of the seventh embodiment is used, the toner leakage from the end seals does not occur thereby to achieve the good result.

In the above-mentioned explanation, while an example that the projections 21A are inclined so that the angles thereof are continuously decreased from the ends to the center was explained, the projections 21A may be inclined only at the ends, or the recesses may be freely designed to achieve the same effect.

As mentioned above, according to the fifth to seventh embodiments, the unevenness extending along the axial direction of the roller is formed on the outer peripheral surface of the foam elastic layer of the toner conveying roller, and each projection has the trapezoidal shape having the bottom greater than the top, and the angle ∠a of the corner of the projection which firstly abuts against the abut member (developing sleeve) and the angle ∠b of the corner which lastly abuts against the abut member are selected to satisfy the relation ∠a≦∠b (and, 90°≦∠b). As a result, the toner on the abut member can be scraped by the mechanical force without deterioration of the toner and deterioration and damage of the abut member, thereby using the toner scraping ability stably and efficiently while maintaining the toner conveying ability.

While the present invention was explained with reference to specific embodiments, various alterations and modifications can be made within the scope of the invention.

What is claimed is:

1. A toner conveying roll comprising:

a rotary shaft; and a foamed elastic body provided around said rotary shaft, wherein projections are formed on a peripheral portion of said foamed elastic body, and each protection extends along an axial direction and has a substantially trapezoidal cross-section.

2. A toner conveying roll according to claim 1, wherein, defining a cell diameter of said surface layer as a, a circumferential length of an outer peripheral surface of said projection as b, a distance between circumferential centers of the outer peripheral surfaces of said projections as d, a height of said projection as c and a circumferential length of a root portion of said projection as e respectively, the following relations are satisfied:

$$a \leqq b \leqq e < d \text{ and } a \leqq c.$$

3. A toner conveying roll according to claim 2, wherein a relation c≦d is satisfied.

4. A toner conveying roll according to claim 1, wherein, defining a circumferential length of an outer peripheral surface of said projection as b, a distance between circumferential centers of the outer peripheral surfaces of said projections as d, a circumferential length of a root portion of said projection as e and a circumferential length of a bottom of a recess as f respectively, the following relation is satisfied:

$$(2b+e-f) \leqq d.$$

5. A toner conveying roll according to claim 1, wherein, defining a sectional area of said projection of said surface layer as S1 and a sectional area of a recess as S2, the following relation is satisfied:

$$S1 \leqq S2.$$

6. A toner conveying roll according to claim 1, wherein a sectional configuration of the projection has a bottom length greater than a top length, and a size of the section of the projection is varied periodically in a circumferential direction.

7. A toner conveying roll according to claim 6, wherein higher projections and lower projections are alternately disposed in the circumferential direction.

8. A developing apparatus comprising:

a developing container containing developer;

a developer bearing member provided at an opening portion of said developing container for bearing and conveying the developer;

a scrape and supply rotary member for scraping and supplying developer while contacting with said developer bearing member, wherein said scrape and supply rotary member includes a rotary shaft; and a foamed elastic body provided around said rotary shaft, wherein projections are formed on a peripheral portion of said foamed elastic body, and each projection extends along an axial direction and has a substantially trapezoidal cross-section.

9. A developing apparatus according to claim 8, wherein, defining a cell diameter of said surface layer as a, a circumferential length of an outer peripheral surface of said projection as b, a distance between circumferential centers of the outer peripheral surfaces of said projections as d, a height of said projection as c and a circumferential length of a root portion of said projection as e, the following relations are satisfied:

$$a \leqq b \leqq e < d \text{ and } a \leqq c.$$

10. A developing apparatus according to claim 9, wherein a relation c≦d is satisfied.

11. A developing apparatus according to claim 9, wherein defining a nip width between said scrape and supply rotary member and said developer bearing member as W, a relation d≦W is satisfied.

12. A developing apparatus according to claim 8, wherein, difining a circumferential length of an outer peripheral surface of said projection as b, a distance between circumferential centers of the outer peripheral surfaces of said projections as d, a circumferential length of a root portion of said projection is e and a circumferential length of a bottom of a recess as f, the following relation is satisfied:

$$2b+e-f \leqq d.$$

13. A developing apparatus according to claim 8, wherein, defining a sectional area of said projection of said surface layer as S1 and a sectional area of a recess as S2, the following relation is satisfied:

$$S1 \leqq S2.$$

14. A developing apparatus according to claim 8, wherein a sectional configuration of the projection has a bottom length greater than a top length, and a magnitude of the section of said projection is varied periodically in a circumferential direction.

15. A developing apparatus according to claim 14, wherein higher projections and lower projections are alternately disposed in the circumferential direction.

16. A developing apparatus according to claim 8, wherein a sectional configuration of the projection has a bottom length greater than a top length, and, defining an angle of a corner of said projection which firstly abuts against said developer bearing member as a and an angle of a corner which lastly abuts against said developer bearing member as b, the following relations are satisfied:

$$a \leqq b \text{ and } 90° \leqq b.$$

17. A developing apparatus according to claim 8, wherein a sectional configuration of said projection has a bottom length greater than a top length, and the projection is inclined with respect to an axis.

18. A developing apparatus according to claim 17, wherein the projection is inclined so that a center of said projection is positioned at a downstream side of one end of said projection in a rotational direction.

19. A developing apparatus according to claim 18, wherein an inclined angle of said projection with respect to the axis is 45° or less.

20. A developing apparatus according to claim 19, wherein the inclined angle is decreased toward the center and becomes zero at the center.

21. A developing apparatus according to claim 8, wherein the developer is nonmagnetic one-component toner.

22.A developing apparatus according to claim 8, wherein an alternating voltage is applied to said developer bearing member.

* * * * *

UNITED STATES PATENT AND TRADEMARK OFFICE

CERTIFICATE OF CORRECTION

PATENT NO. : 6,026,265

DATED : February 15, 2000

INVENTOR(S) : MASAHIDE KINOSHITA ET AL.

It is certified that error appears in the above-identified patent and that said Letters Patent is hereby corrected as shown below:

ON THE COVER PAGE

Item [56] FOREIGN PATENT DOCUMENTS

"05061350 3/1993 Japan.
5-61350 3/1993 Japan." should read --5-61350 3/1993 Japan.--
"06138774" should read --6-138744--.

OTHER PUBLICATIONS

"28 Aug. 17," should read --August 17,--.

COLUMN 1

Line 29, "runner" should read --rubber--,
Line 41, "non-magnetic" should read --nonmagnetic--,
Line 50, "as the" should read --as to--,
Line 61, "is" should read --as--, and
Line 66, "solid" should read --solid rubber--.

UNITED STATES PATENT AND TRADEMARK OFFICE

CERTIFICATE OF CORRECTION

PATENT NO. : 6,026,265

DATED : February 15, 2000

INVENTOR(S) : MASAHIDE KINOSHITA ET AL.

It is certified that error appears in the above-identified patent and that said Letters Patent is hereby corrected as shown below:

COLUMN 2
Line 3, "are" should read --are laid--.

COLUMN 4
Line 13, "can" should read --can be--.

COLUMN 5
Line 21, "born" should read --borne--, and
Line 47, "changed" should be deleted.

COLUMN 6
Line 13, "As a method" should read --The following three methods may be used--, and
Line 21, "Since" should be deleted.

COLUMN 7
Line 42, "is" should be deleted.

UNITED STATES PATENT AND TRADEMARK OFFICE

CERTIFICATE OF CORRECTION

PATENT NO. : 6,026,265

DATED : February 15, 2000

INVENTOR(S) : MASAHIDE KINOSHITA ET AL.

It is certified that error appears in the above-identified patent and that said Letters Patent is hereby corrected as shown below:

COLUMN 8

Line 2, "can" should read --can be--,

Line 28, "to" should read --so as to--,

Line 29, "behave to" should be deleted, and

Line 67, "a." should read --"a".--.

COLUMN 9

Line 26, "a" should read --"a"--.

COLUMN 10

Line 59, "is" should be deleted.

COLUMN 11

Line 12, "a," should read --"a",--.

UNITED STATES PATENT AND TRADEMARK OFFICE

CERTIFICATE OF CORRECTION

PATENT NO. : 6,026,265

DATED : February 15, 2000

INVENTOR(S) : MASAHIDE KINOSHITA ET AL.

It is certified that error appears in the above-identified patent and that said Letters Patent is hereby corrected as shown below:

COLUMN 12

Line 6, "and photo-taking such a" should read --with which a photograph is made of the--, and Line 45, "sheet" should read --sheets--.

COLUMN 13

Line 11, "Evaluating" should read --Evaluation--.

Table 3, "used" should read --use--,

Line 27, "used" should read --use--,

Line 32, "used" should read --use,--, and

Line 58, "used" should read --use--.

COLUMN 14

Line 19, "is" should be deleted,

Line 22, "and photo-taking such a" should read --with which a photograph is made of the--, Line 25, "constructural" should read --structural--,

UNITED STATES PATENT AND TRADEMARK OFFICE

CERTIFICATE OF CORRECTION

PATENT NO. : 6,026,265

DATED : February 15, 2000

INVENTOR(S) : MASAHIDE KINOSHITA ET AL.

It is certified that error appears in the above-identified patent and that said Letters Patent is hereby corrected as shown below:

COLUMN 14, Cont'd.
Line 51, "used" should read --use--, and
Line 54, "constructural" should read --structural--.

COLUMN 15
Line 20, "component" should read --component,--.

COLUMN 16
Line 40, "were adhered" should read --adhered--.

COLUMN 17
Line 4, "a" should read --"a"--,
Line 22, "satisfy" should read --satisfies--,
Line 32, "under the" should read --under--, and
Line 39, "half tone" should read --halftone--.

UNITED STATES PATENT AND TRADEMARK OFFICE

CERTIFICATE OF CORRECTION

PATENT NO. : 6,026,265

DATED : February 15, 2000

INVENTOR(S) : MASAHIDE KINOSHITA ET AL.

It is certified that error appears in the above-identified patent and that said Letters Patent is hereby corrected as shown below:

COLUMN 20

Line 61, "is" should read --as--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*